US008393605B2

(12) United States Patent
Yang et al.

(10) Patent No.: US 8,393,605 B2
(45) Date of Patent: Mar. 12, 2013

(54) POSITIONING FIXTURE

(75) Inventors: Guang Yang, Shenzhen (CN); Hong-Wei Ren, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 118 days.

(21) Appl. No.: 13/110,016

(22) Filed: May 18, 2011

(65) Prior Publication Data

US 2012/0181737 A1 Jul. 19, 2012

(30) Foreign Application Priority Data

Jan. 14, 2011 (CN) ..... 2011 1 0008137

(51) Int. Cl.
*B25B 11/00* (2006.01)

(52) U.S. Cl. ..... 269/287; 269/289 R; 269/309

(58) Field of Classification Search ..... 409/130; 269/93, 71, 55, 310, 309, 303, 300, 291, 269/289 R, 287, 228, 227, 136, 138; 144/145.1, 144/145.2, 144.51, 144.1; *B25B 5/12*
See application file for complete search history.

(56) References Cited

U.S. PATENT DOCUMENTS

| | | | | | |
|---|---|---|---|---|---|
| 3,789,892 | A * | 2/1974 | Converse et al. | ..... | 144/144.51 |
| 3,872,760 | A * | 3/1975 | Desnoyers, Jr. | ..... | 83/743 |
| 4,644,985 | A * | 2/1987 | Weaver | ..... | 144/145.1 |
| 5,383,503 | A * | 1/1995 | Johnson | ..... | 144/144.51 |
| 5,435,533 | A * | 7/1995 | Weinmann, Jr. | ..... | 269/228 |
| 5,732,937 | A * | 3/1998 | Morghen | ..... | 269/47 |
| 5,931,726 | A * | 8/1999 | Peters | ..... | 451/305 |
| 5,960,843 | A * | 10/1999 | Witt | ..... | 144/372 |
| 6,138,726 | A * | 10/2000 | Newman | ..... | 144/371 |
| 6,164,636 | A * | 12/2000 | Taylor | ..... | 269/287 |
| 6,182,371 | B1 * | 2/2001 | Newman | ..... | 33/194 |
| 6,262,582 | B1 * | 7/2001 | Barringer et al. | ..... | 324/756.01 |
| 6,293,322 | B1 * | 9/2001 | Wilson-South | ..... | 144/372 |
| 6,484,378 | B1 * | 11/2002 | Arvin | ..... | 29/281.5 |
| 7,651,079 | B2 * | 1/2010 | Lee et al. | ..... | 269/21 |
| 7,721,776 | B2 * | 5/2010 | Justin | ..... | 144/144.51 |
| 2009/0096143 | A1 * | 4/2009 | Wampler, II | ..... | 269/10 |

FOREIGN PATENT DOCUMENTS

CN 2574079 Y 9/2003

* cited by examiner

*Primary Examiner* — Lee D Wilson
*Assistant Examiner* — Tyrone Hall, Jr.
(74) *Attorney, Agent, or Firm* — Altis Law Group, Inc.

(57) ABSTRACT

A positioning fixture for positioning a workpiece includes a base, a support mounted on the base and for receiving the workpiece, two toggle clamps mounted on two opposite sides of the base and the support and an upper cover placed on the support. The upper cover cooperates with the two toggle clamps to position the workpiece on the support.

3 Claims, 4 Drawing Sheets

POSITIONING FIXTURE

BACKGROUND

1. Technical Field

The present disclosure relates to positioning fixtures and, particularly, to a positioning fixture for positioning a workpiece.

2. Description of Related Art

In general, workpieces are often manually positioned first, and then are machined. Such a method of positioning the workpieces is prone to error, and can result in low processing precision.

Therefore, what is needed is a positioning fixture to overcome the described limitations.

SUMMARY

A positioning fixture for positioning a workpiece is provided. The positioning fixture includes a base, a support mounted on the base and for receiving the workpiece, two toggle clamps mounted on two opposite sides of the base and the support, and an upper cover placed on the support, and cooperating with the two toggle clamps to position the workpiece on the support. The support defines a recessed portion on its top surface for receiving the workpiece therein. The support includes two pairs of pins set in opposite sides of the recessed portion, two pairs of first positioning blocks respectively mounted on opposite sides of the recessed portion, a second positioning block mounted on another side of the recessed portion, and two third positioning blocks mounted on another side thereof away from the second positioning block. Two pairs of first holes aligned with the pins are defined in a lower surface of the upper cover. The upper cover is pushed to slide along the first positioning blocks and the third positioning blocks until it is resisted by the second positioning block and the pins are received into the first holes, thereby limiting the upper cover on the support.

DETAILED DESCRIPTION

Figure 1:
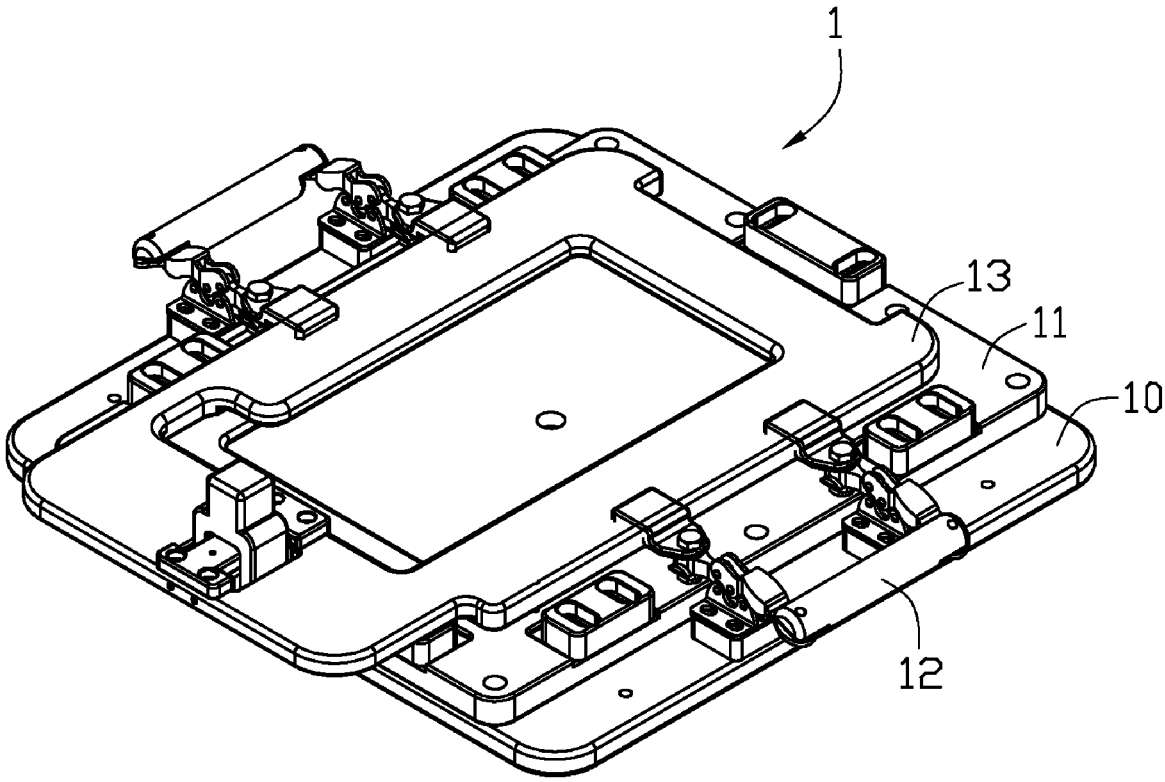
FIG. 1 is an isometric view of a positioning fixture in accordance with an exemplary embodiment.
Figure 2:
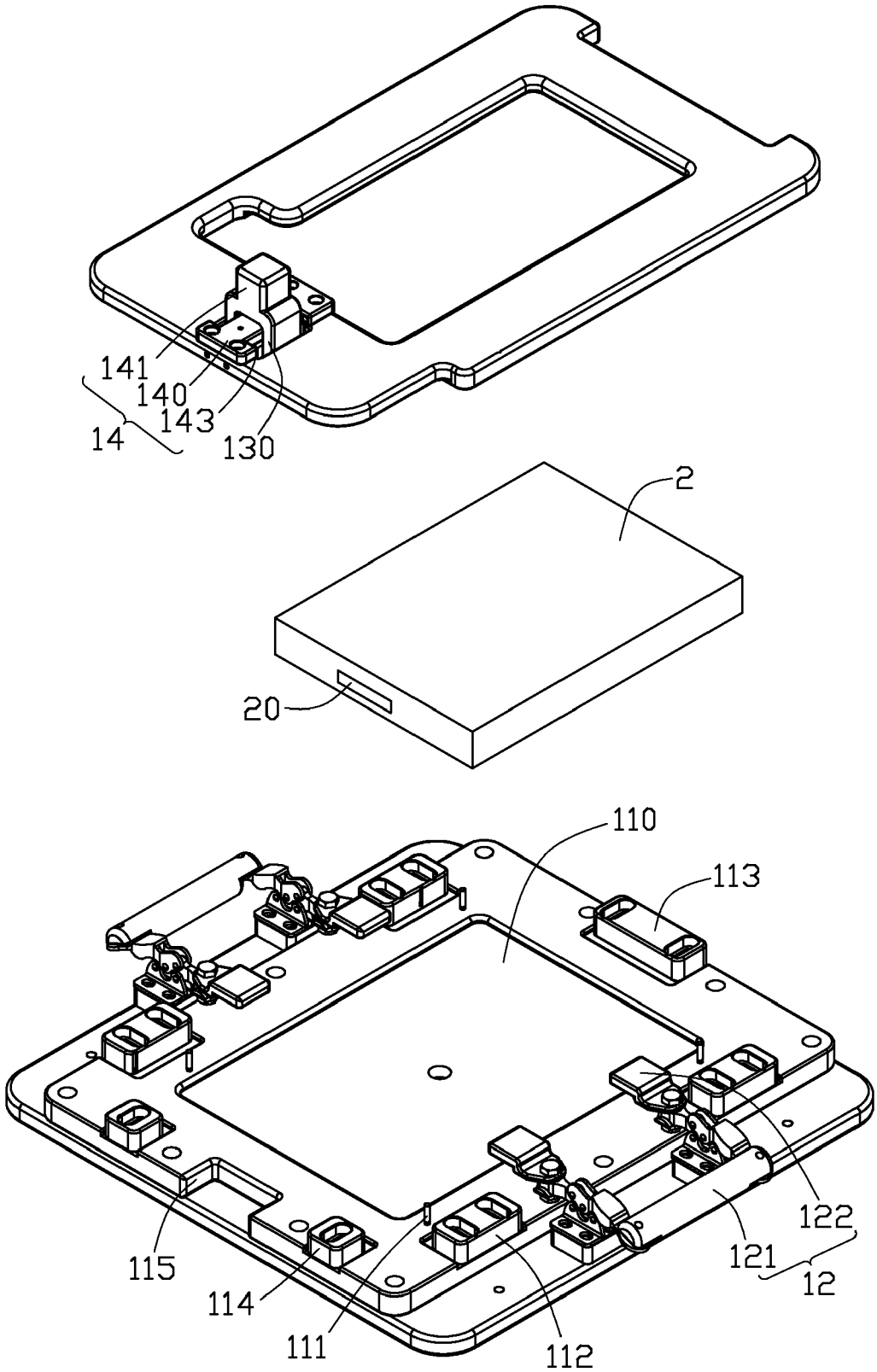
FIG. 2 is a partially exploded view of the positioning fixture of FIG. 1.

Referring to FIGS. 1-2, an embodiment of a positioning fixture 1 for positioning a workpiece 2 is illustrated. The positioning fixture 1 includes a base 10 and a support 11 mounted on the base 10. The support 11 is configured for receiving the workpiece 2 to be positioned.

The positioning fixture 1 further includes two toggle clamps 12 respectively fixed on two opposite ends of the base 10 and the support 11, and an upper cover 13 placed on the workpiece 2. The upper cover 13 cooperates with the two toggle clamps 12 to fixe the workpiece 2 on the support 11. In order to better understand the disclosure, an exemplary embodiment is described in detail.

Figure 3:
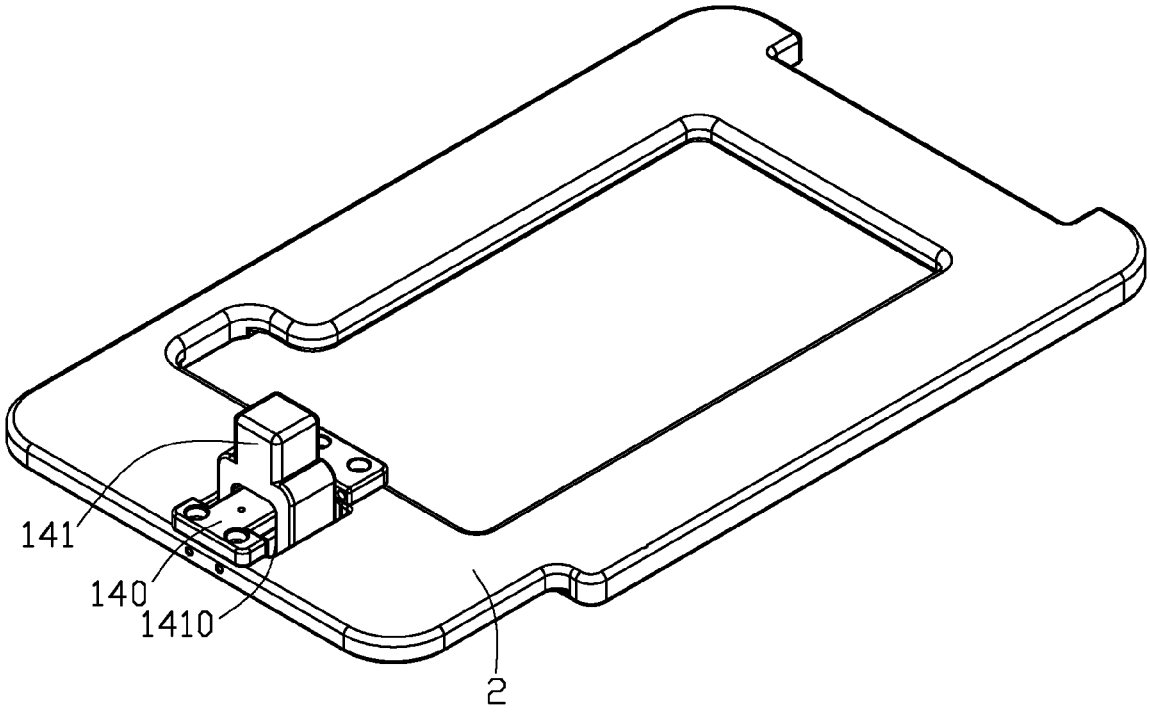
FIG. 3 is an enlarged view of an upper cover of the positioning fixture of FIG. 1.
Figure 4:
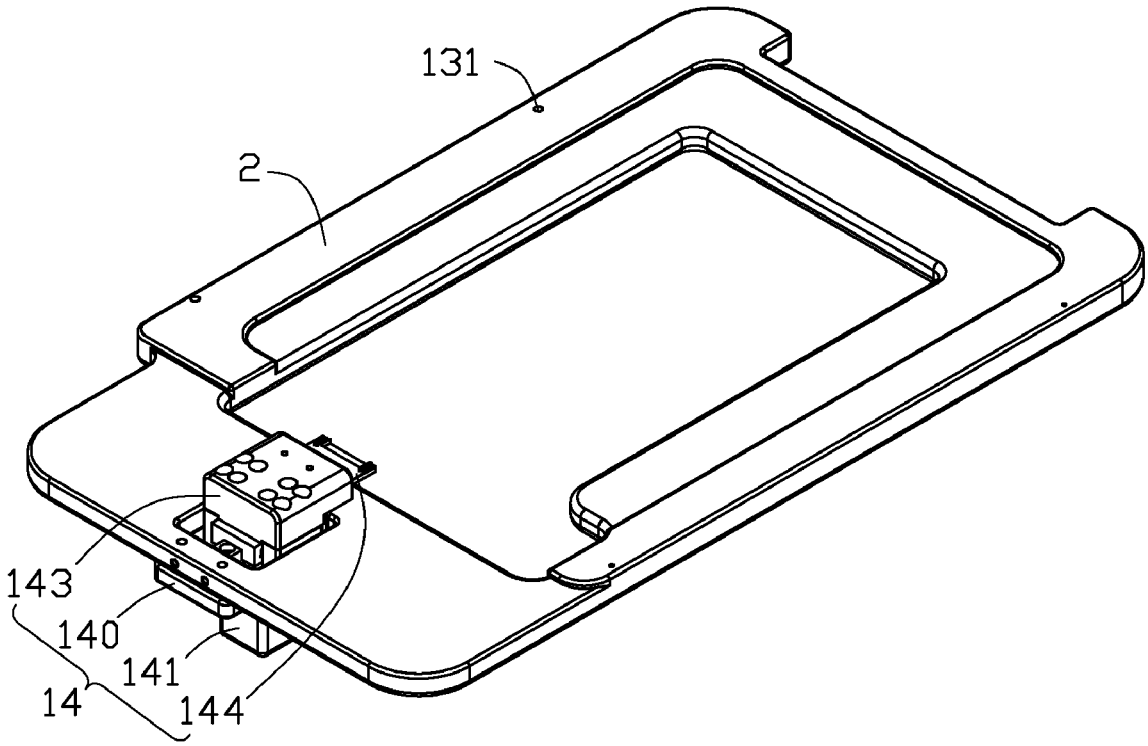
FIG. 4 is another enlarged view of the upper cover of the positioning fixture of FIG. 1, viewed from another aspect.

Referring to FIGS. 3-4, the support 11 defines a recessed portion 110 for receiving the workpiece 2 on its top surface. The support 11 includes two pairs of pins 111 set in opposite sides of the recessed portion 110. The support 11 further includes two pairs of first positioning blocks 112 respectively mounted on opposite sides thereof, and a second positioning block 113 mounted on another side thereof. The support 11 further includes two third positioning blocks 114 mounted on another side thereof away from the second positioning block 113. The support 11 further defines a gap 115 between the two third positioning blocks 114.

Each toggle clamp 12 includes an operation portion 121 and a fixing portion 122 engaged with the operation portion 121. When the operation portion 121 is raised up by the user, the fixing portion 122 is driven up by the operation portion 121, and when the operation portion 121 is pressed down by the user, the fixing portion 122 is driven down by the operation portion 121.

A second hole 130 is defined in one end of the upper cover 13. Two pairs of first holes 131 aligned with the pins 111 are defined in a lower surface of the upper cover 13. The upper cover 13 is pushed by the user to slide along the first positioning blocks 112 and the third positioning blocks 114 until it is resisted by the second positioning block 114 and the two pins 111 are received into the first holes 131, thereby limiting the upper cover 13 on the support 11.

The positioning fixture 1 further includes an engagement mechanism 14 slidably connected to the upper cover 13. The engagement mechanism 14 includes a sliding pole 140, a handle 141 slidably connected to the sliding pole 140, a sliding block 143 mounted on a bottom of the handle 141, and an extending portion 144 connected to the sliding block 143. The size of the sliding block 143 matches that of the gap 115. The handle 141 passes through the second hole 130, and defines a perforation 1410 above the upper cover 13. The sliding pole 140 passes through the perforation 1410, thereby slidably connecting the engagement mechanism 14 to the upper cover 13. The sliding block 143 is movable along the gap 115 by the handle 141. An opening 20 is defined in one end of the workpiece 2 sized to receive the extending portion 144.

To position the workpiece 2, the operation portion 121 is raised up to drive the fixing portion 122 to rise. The workpiece 2 is placed in the recessed portion 110 of the support 11. The upper cover 13 is pushed by the user along the first positioning blocks 112 and until it is resisted by the second positioning blocks 114 and the pins 111 are received into the first holes 131, thereby limiting the upper cover 13 on the support 11. Then, the handle 141 is pushed by the user to drive the sliding block 143 to move along the gap 114 until the extending portion 144 is received into the opening 20. Finally, the operation portion 121 of the toggle clamp 12 is pressed down to drive the fixing portions 122 to press the top surface of the upper cover 13, thereby fixing the workpiece 2 between the support 11 and the upper cover 13, and providing convenience for the user to machine the workpiece 2.

After the workpiece 2 is machined, the operation portion 121 is raised up to drive the fixing portion 122 to rise, thereby releasing the hold on the upper cover 13. The handle 141 is pulled by the user until the extending portion 144 is moved out of the opening 20. Finally, the upper cover 13 and the engagement mechanism 14 are moved out from the support 11, and the workpiece 2 can be taken out of the support 11.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A positioning fixture for positioning a workpiece, comprising:

a base;

a support mounted on the base and defining a recessed portion on its top surface for receiving a workpiece, wherein the support comprises two pairs of pins set in opposite sides of the recessed portion, two pairs of first positioning blocks respectively mounted on opposite sides of the recessed portion, a second positioning block mounted on another side of the recessed portion and two third positioning blocks mounted on another side thereof away from the second positioning block;

two toggle clamps mounted on two opposite sides of the base and the support; and an upper cover placed on the support, wherein two pairs of first holes aligned with the pins are defined in a lower surface of the upper cover, the upper cover is pushed to slide along the first positioning blocks and the third positioning blocks until it is resisted by the second positioning block and the pins are received into the first holes, thereby limiting the upper cover on the support, and the upper cover cooperates with the two toggle clamps to position the workpiece on the support.

2. The positioning fixture as described in claim 1, wherein a second hole is defined on one end of the upper cover, the positioning fixture further comprises an engagement mechanism, the engagement mechanism comprises a sliding pole, a handle slidably connected to the sliding pole, a sliding block mounted on a bottom of the handle, and an extending portion connected to the sliding block, the handle passes through the second hole, and defines a perforation above the upper cover, the sliding pole passes through the perforation, thereby slidably connecting the engagement mechanism to the upper cover, an opening is defined on the workpiece sized to receive the extending portion, the handle is pushed to drive the sliding block to move until the extending portion is received into the opening.

3. The positioning fixture as described in claim 2, wherein the support further defines a gap between the two third positioning blocks, the two third positioning blocks provides a sliding track for the upper cover, and the gap provides a sliding space for the sliding block.

* * * * *